US005980221A

United States Patent [19]

Uffelman

[11] Patent Number: 5,980,221

[45] Date of Patent: Nov. 9, 1999

[54] FUEL PUMP PULSE DAMPER

[75] Inventor: Bradley L. Uffelman, Caro, Mich.

[73] Assignee: Walbro Corporation, Cass City, Mich.

[21] Appl. No.: 08/958,221

[22] Filed: Oct. 27, 1997

[51] Int. Cl.[6] ..... F04B 11/00

[52] U.S. Cl. ..... 417/540

[58] Field of Search ..... 417/540, 316, 417/542, 366, 423.3

[56] References Cited

U.S. PATENT DOCUMENTS

| | | | |
|---|---|---|---|
| 4,401,416 | 8/1983 | Tuckey | 417/283 |
| 4,571,159 | 2/1986 | Beardmore | 417/366 |
| 4,596,519 | 6/1986 | Tuckey | 418/15 |

FOREIGN PATENT DOCUMENTS

| | | |
|---|---|---|
| 180172 | 7/1993 | Japan . |

*Primary Examiner*—Timothy S. Thorpe
*Assistant Examiner*—David J. Torrente
*Attorney, Agent, or Firm*—Reising, Ethington, Barnes, Kisselle, Learman & McCulloch, P.C.

[57] ABSTRACT

An electric motor and a fuel pump are received within a circumferentially continuous cylindrical shell formed of a somewhat flexible and substantially resilient plastic material to at least partially absorb and reduce the dynamic fuel pressure pulses produced by the fuel pump. The plastic material of the shell tends to flex slightly when acted upon by the dynamic fuel pressure pulses produced by the operating fuel pump to absorb the pressure pulses and reduce their magnitude. Reducing the magnitude of the pressure pulses reduces the noise of the operating fuel pump and helps to achieve a smoother and more pulse free flow of fuel out of the fuel pump assembly outlet. The plastic shell material also reduces vibrations of the fuel pump module to reduce wear on the module and further decrease the noise of the fuel pump in use.

10 Claims, 1 Drawing Sheet

FUEL PUMP PULSE DAMPER

FIELD OF THE INVENTION

This invention relates to fuel pumps and more particularly to a fluid pulse and noise damper for a fuel pump of a fuel delivery system.

BACKGROUND OF THE INVENTION

Rotary fuel pumps driven by an electric motor have been utilized in fuel delivery systems to deliver fuel under pressure to an internal combustion engine. The pump and power unit are frequently in a common housing mounted in the fuel tank of the vehicle as shown, for example, in U.S. Pat. No. 4,401,416. During operation, a fuel pump will produce a humming noise and especially under higher fuel demands, this noise may be audible to passengers in the vehicle and thus, it is desirable to minimize the noise level of an operating fuel pump.

During the pumping cycle, as one pumping cell is exhausting fuel another cell is taking in fuel at the same time. It has been noted that pressure waves or pulses are present at the inlet cell as well as the outlet cell at all operating pressures and these pressure pulses increase the operating noise of the fuel pump. This increases as the output pressure requirement of the fuel pump is increased due to the increased pressure differential across the pump which increases the magnitude of the dynamic pressure pulses of the fuel. Under increased output pressure requirements, the outlet of the fuel pump can be operating at an average pressure on the order of 60 psig or more while the inlet is usually at an average pressure close to atmospheric. In addition to the noise at increased pressure differentials, the pressure pulses effect the delivery of the fuel from the fuel pump by creating pulses of fuel from the outlet of the fuel pump rather than a smooth flow of the fuel from the pump.

SUMMARY OF THE INVENTION

A fuel pump assembly housed within a circumferentially continuous cylindrical shell formed of a somewhat flexible and substantially resilient plastic material to at least partially absorb and reduce the dynamic pressure pulses produced by the fuel pump. The plastic material of the shell tends to flex slightly when acted upon by the dynamic pressure pulses produced by the operating fuel pump to absorb the pressure pulses and reduce their magnitude. Reducing the magnitude of the pressure pulses reduces the noise of the operating fuel pump and helps to achieve a smoother and more pulse free flow of fuel out of the fuel pump outlet. The plastic shell material also reduces vibrations of the fuel pump module to reduce wear on the module and further decrease the noise of the fuel pump in use.

Objects, features and advantages of this invention are to provide a pressure pulse dampening for a fuel pump which is easily and economically provided from a cylindrical outer shell of a plastic material which is resilient and flexible to flex and absorb the pressure pulses acting on it, is readily adaptable to current fuel pump designs, helps to achieve a smoother and more pulse-free flow of fuel out of the fuel pump outlet, reduces the noise of the fuel pump during use, is resistant to corrosion or degradation, is of relatively simple design and economical manufacture and assembly, is stable, rugged, durable, reliable and in-service has a long useful life.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENT

Figure 2:
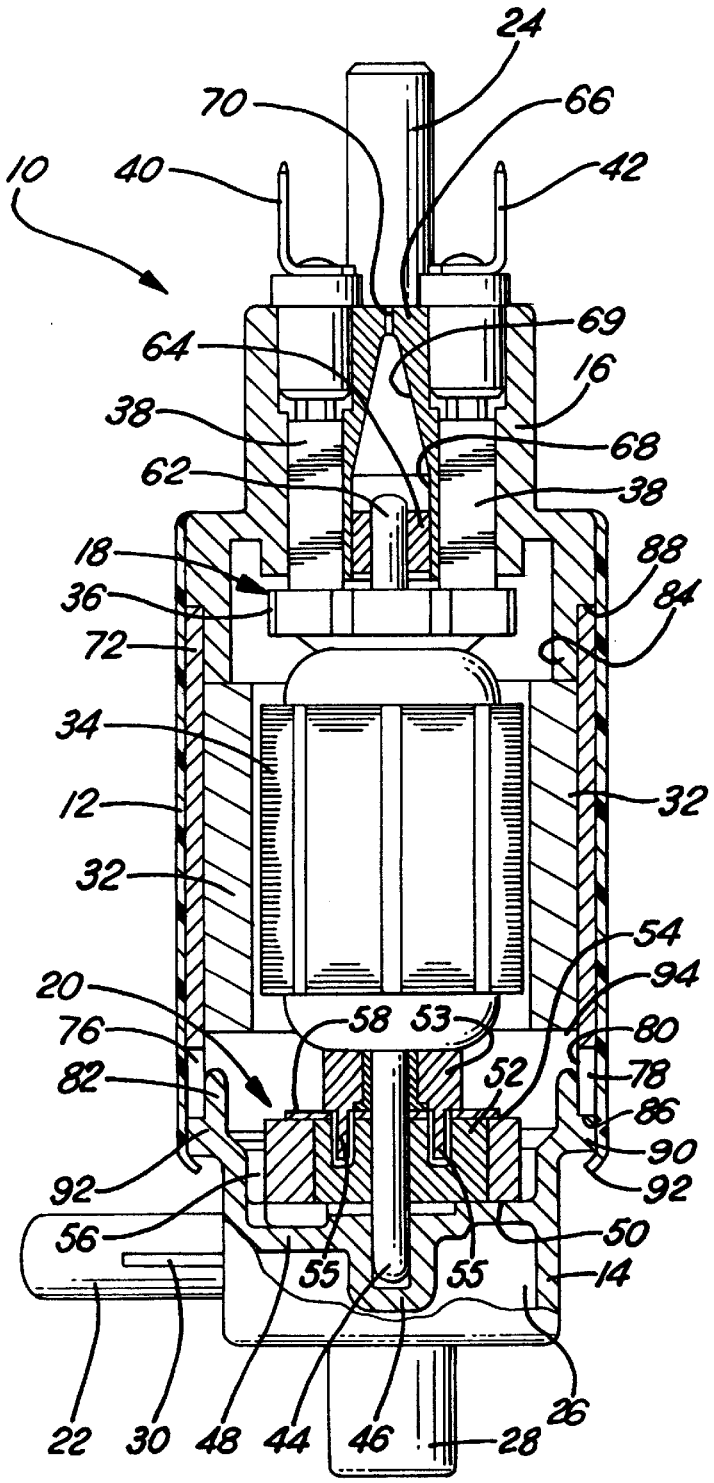
FIG. 2 is a sectional view of a fuel pump with a cylindrical plastic outer shell in accordance with the presently preferred embodiment of this invention.
Figure 1:
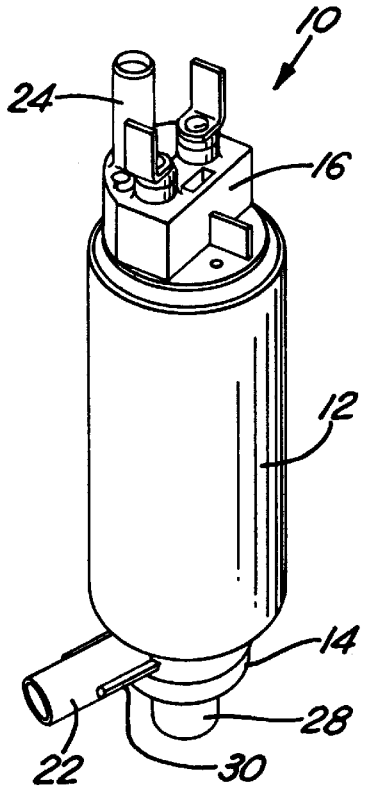
FIG. 1 is a perspective view of a fuel pump embodying this invention.

Referring in more detail to the drawings, FIGS. 1 and 2 illustrate a fuel pump assembly 10 having a circumferentially continuous cylindrical outer shell 12 of a plastic material sealed adjacent one end to an inlet body 14 and adjacent its other end to an outlet body 16 and having an electric motor 18 and a fuel pump 20 received therein. The inlet body 14 has an inlet conduit 22 preferably associated with a filter through which fuel is drawn into the fuel pump 20 which pressurizes the fuel and delivers it through an outlet passage 24 formed in the outlet body 16. The fuel pump assembly 10 is preferably received in a fuel pump module mounted in a fuel tank of a vehicle such as an automobile and supplies fuel to a fuel rail and fuel injectors of an engine of the automobile through an interconnecting fuel line in communication with the outlet passage 24. Preferably, the speed and hence the output of the fuel pump 10 is variable to supply liquid fuel to the rail at the desired pressure.

The inlet body or end cap 14 is preferably formed of a plastic material and connected to one end of the shell 12 preferably by ultrasonic welding to the shell 12 to provide a seal between them and prevent fuel leakage exteriorly of the inlet body 14. The inlet body 14 has a passage 26 therethrough in communication with a venturi 28 at one end and with the inlet of the fuel pump 20 at the other end. A portion of the fuel drawn into the fuel pump 10 is discharged through the venturi 28. Fuel flow through the venturi 28 creates a pressure drop to increase the rate at which fuel is drawn into the fuel pump module. To facilitate mounting the fuel pump 10 within a fuel pump module the inlet conduit 22 may act as a mounting stem and is constructed to be press-fit into a complementarily shaped recess in the module.

The outlet body or end cap 16 is preferably formed of a plastic material, at least partially received within the other end of the outer shell 12 and ultrasonically welded to the outer shell 12 to seal the components together. The outlet body 16 has an outlet passage 24 therethrough in communication with the outlet of the fuel pump 20 at one end and with the exterior of the fuel pump 10 adjacent its other end. To facilitate connecting a fuel line to the outlet passage 24, it extends longitudinally from the outlet body 16 and is constructed to be telescopically received within the fuel line.

As shown in FIG. 2, the electric motor 18 and fuel pump 20 are encased within the outer shell 12 generally between the inlet body 14 and outlet body 16. Stator magnets 32 are disposed around a rotating armature 34 which has a commutator 36 adjacent one end. Brushes 38 received in the outlet body 16 are yieldably urged against the face of the commutator 36 and are connected to suitable electrical connectors 40, 42. The armature 34 has a mounting shaft 44 journalled in a blind bore 46 formed in a boss 48 of the inlet body 14. An inlet port 50 in the wall 48 admits fuel to the inlet side of the fuel pumping assembly 20 which comprises an inner gear rotor 52 coupled to the shaft 44 by clip 53 having fingers 55 received in holes of the inner gear rotor 52. The inner gear rotor 52 is positioned within an outer gear rotor 54. A pump outlet port 56 is provided through which pump outlet fuel may pass but pump outlet fuel may also pass around a flexible seal 58 which is free to rotate with the outer gear 54 and is pressed against the rotors 52, 54 by the clip 53 mounted between the armature 34 and the seal 58. The gear teeth and the rotors 52, 54 are preferably meshed helical gears as described in U.S. Pat. No. 4,596,519 to reduce and smooth pulsations in the pump 10 output.

At the other end of the armature 34 a mounting shaft 62 is journalled in a pressed on bushing 64 slidably received in a central insert 66 in the outlet body 16. The bushing 64 is affixed to the shaft 62 and is axially movable in the insert 66 in a bore 68 of a recess 69. A small vent 70 is provided adjacent one end of the recess 69 and communicates with the exterior of the fuel pump 10.

Figure 3:
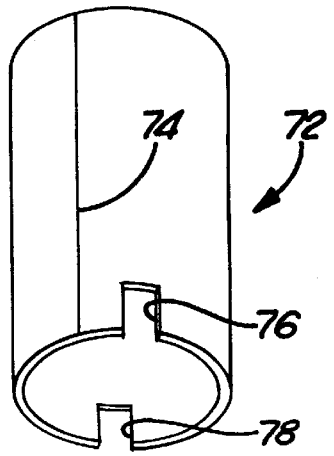
FIG. 3 is a perspective view of a metal casing disposed interiorly of the outer shell.

A metal casing 72 is disposed between the stator magnets 32 and the outer shell 12 to provide a rigid body which accurately aligns the fuel pump 20 and motor components and also provides a ferromagnetic ring adjacent the stator magnets 32. As shown in FIG. 3, the metal casing 72 is preferably formed from a sheet of a ferromagnetic material such as steel rolled to form a tube with a pair of opposed sides of the sheet at least partially connected together to form a seam 74 extending longitudinally of the metal casing 72. Preferably, to communicate the fuel in the fuel pump 10 with the shell 12 to dampen the fuel pressure pulses, at least a portion of the seam 74 is open to the shell 12 and thereby provides a small leak path through which fuel can flow. A pair of slots 76, 78 are formed in the metal casing 72 to align the fuel pumping assembly 20 therein. Preferably, a gap 80 is maintained in the slots 76, 78 between the metal casing 72 and the fuel pump 20 through which fuel is communicated with the shell 12. The metal casing 72 is received over an annular rim 82 of the inlet body 14 and an annular rim 84 of the outlet body 16 until the metal casing 72 engages a shoulder 86 of the inlet body 14 and a shoulder 88 of the outlet body 16.

The outer shell 12 is circumferentially continuous, cylindrical, hollow and has an interior diameter of a size constructed to provide a snug fit with the inlet body 14, outlet body 16 and the metal casing 72 to reduce vibrations of the fuel pump 10 in use. The inlet body 14 preferably has a radially extending flange 90 constructed to engage the shoulder of the outer shell 12 to radially position the inlet body 14 and is retained by an edge 92 of the outer shell 12 ultrasonically welded to it. The flange 90 preferably also provides the shoulder 86 engageable by the metal casing 72 to limit the insertion of the inlet body 14 within the metal casing 72.

The outer shell 12 defines in part a cavity 94 adjacent to the slots 76, 78 and in communication with the outlet of the fuel pump 20 wherein fuel discharged from the fuel pump 20 flows into the cavity 94 and through the slots 76, 78 and preferably also through the seam 74 to contact the shell 12. To be responsive to the fuel pressure pulses acting interiorly of and on the outer shell 12, the outer shell 12 is preferably generally thin walled and made of a substantially resilient plastic material so that it may flex slightly when acted on by the fuel pressure pulses but is resilient enough and strong enough to prevent permanent deformation of the shell 12. The outer shell 12 is preferably formed of a plastic material resistant to corrosion or degradation when used in volatile environments such as within hydrocarbon fuels and has a relatively high toughness while being flexible and resilient. A currently preferred material for the outer shell 12 is sold under the trade name Delrin® commercially available from Dupont. Typically for a pump with an output nominal fuel pressure of 60 psig, the shell 12 has a wall thickness of about 0.04 to 0.08 of an inch and a flexural modulus of about 100 to 410 KPSI.

During assembly preferably all of the electric motor and pump components are subassembled in the casing 72 preferably with a slight interface fit between the end caps 14, 16 and the casing 72. Then this subassembly is telescoped into the outer shell 12 preferably with a slight slip fit. The outer shell 12 is then ultrasonically welded circumferentially continuously to both the inlet body 14 and outlet body 16 to prevent fuel leakage or pressure losses of the fuel pump 10. The fuel pump 10 is then placed within the fuel pump module with the inlet 22 of the inlet body 14 press fit into a recess of the fuel pump module. The outlet passage 24 is connected to the fuel line through which fuel is delivered to the fuel rail.

The fuel pump 10 draws fuel from the fuel pump module or the fuel tank and delivers that fuel under pressure to the fuel rail through the fuel line. The dynamic fuel pressure pulses created within the fuel pump 10 due to the positive displacement gear-rotor fuel pump 20 are dampened by the interaction of the fuel with the plastic outer shell 12 which is resilient and somewhat flexible to reduce the magnitude of the pulses. The outer shell is believed to reduce the magnitude of the pressure pulses in the outlet fuel both by absorbing and dissipating energy and by returning energy to the fuel out of phase with the pump produced pressure pulses to oppose them and thereby reduce their maximum amplitude. Reducing the pressure pulses reduces the vibrations of the fuel pump 10, reduces the noise of the fuel pump 10 and helps to provide a more steady supply of fuel from the fuel pump 10.

I claim:

1. A fuel pump module comprising:

a fuel pump having an inlet and an outlet;

a housing having a generally cylindrical and circumferentially continuous outer side wall formed of a flexible and resilient plastic material and having an inner surface and an outer surface, the housing enclosing the fuel pump with the pump outlet communicating with the inner surface of the side wall of the housing, and at least substantially all of the outer surface of the side wall of the housing being exposed to the exterior of the fuel pump module;

a fuel inlet carried by the housing and constructed to communicate the exterior of the housing with the pump inlet;

a fuel outlet carried by the housing and constructed to supply liquid fuel from the interior to the exterior of the housing; and a cavity between the pump outlet and the fuel outlet and defined in part by the side wall whereby the fuel pump draws fuel through the fuel inlet and delivers fuel under pressure to the cavity and the plastic side wall flexes to at least partially reduce pressure pulses in the fuel discharged from the fuel outlet when the pump is operating.

2. The fuel pump of claim 1 wherein the housing comprises an inlet body and an outlet body and the side wall is disposed and extends between the inlet body and the outlet body.

3. The fuel pump of claim 1 also comprising an electric motor which drives the fuel pump and is received within the housing.

4. The fuel pump of claim 2 also comprising a seal provided between the inlet body and the side wall and between the outlet body and the side wall.

5. The fuel pump of claim 4 wherein the inlet body and outlet body are each of a plastic material and heat sealed to the side wall adjacent to an opposite end of the side wall.

6. The fuel pump of claim 5 wherein the inlet body and outlet body are ultrasonically welded to the side wall.

7. The fuel pump of claim 2 wherein the side wall has an annular and inwardly extending rim adjacent one end constructed to engage the inlet body to retain the inlet body in the side wall.

8. The fuel pump of claim 1 also comprising a cylindrical metal sleeve adjacent to and encircling the fuel pump and received within and adjacent the side wall.

9. The fuel pump of claim 8 wherein the sleeve has at least one slot formed therethrough and adjacent the cavity which is at least partially open to the side wall.

10. The fuel pump of claim 8 wherein the sleeve is of a ferromagnetic material.

* * * * *